United States Patent [19]

Reimann

[11] Patent Number: 5,027,764

[45] Date of Patent: Jul. 2, 1991

[54] METHOD OF AND APPARATUS FOR IGNITING A GAS/FUEL MIXTURE IN A COMBUSTION CHAMBER OF AN INTERNAL COMBUSTION ENGINE

[76] Inventor: Michael Reimann, Kohlgasse 23, D-7900 Ulm, Fed. Rep. of Germany

[21] Appl. No.: 515,626

[22] Filed: Apr. 26, 1990

[51] Int. Cl.[5] ..... F02P 23/04; F02M 27/08

[52] U.S. Cl. ..... 123/143 B; 123/536

[58] Field of Search ..... 123/143 B, 193 P, 536, 123/590, 605, 606, 620

[56] References Cited

U.S. PATENT DOCUMENTS

| | | | |
|---|---|---|---|
| 3,943,407 | 3/1976 | Bolasny | 123/536 X |
| 4,138,980 | 2/1979 | Ward | 123/143 B |
| 4,297,983 | 11/1981 | Ward | 123/536 |
| 4,441,479 | 4/1984 | Endo et al. | 123/143 B X |
| 4,446,826 | 5/1984 | Kimura et al. | 123/143 B |
| 4,520,786 | 6/1985 | Thatcher et al. | 123/536 |
| 4,766,855 | 8/1988 | Tozzi | 123/143 B |
| 4,841,925 | 6/1989 | Ward | 123/143 B |
| 4,947,640 | 8/1990 | Few et al. | 123/143 B X |

FOREIGN PATENT DOCUMENTS

| | | | |
|---|---|---|---|
| 2421711 | 11/1975 | Fed. Rep. of Germany | 123/536 |

*Primary Examiner*—Willis R. Wolfe

[57] ABSTRACT

A method of and an apparatus for igniting a gas/fuel mixture in at least one combustion chamber of an internal combustion engine, said combustion chamber being supplied with fuel and gas, are suggested in which an expanding pulse-shaped pressure wave of high energy density is generated in said combustion chamber, which pressure wave triggers a self-ignition of said mixture in the combustion chamber due to a local temperature increase.

15 Claims, 2 Drawing Sheets

Figure 2:
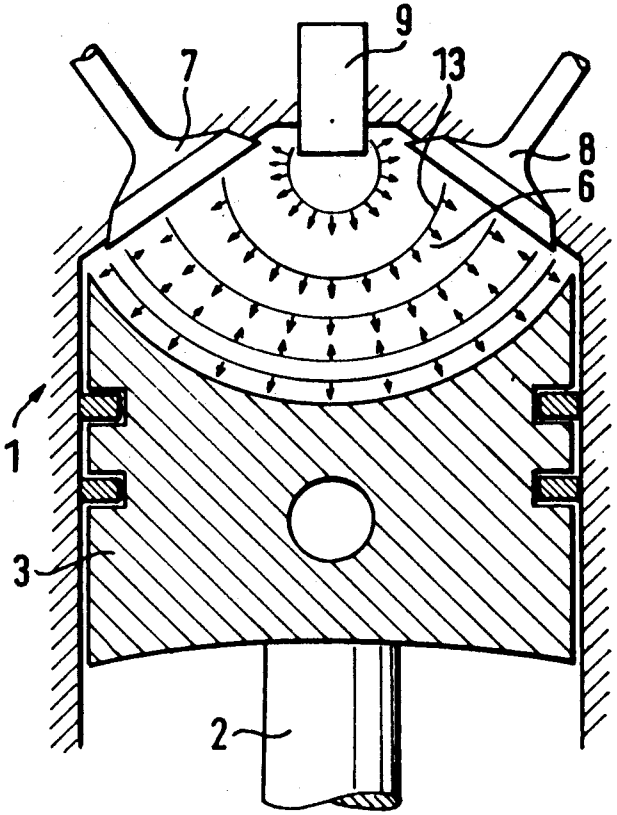

METHOD OF AND APPARATUS FOR IGNITING A GAS/FUEL MIXTURE IN A COMBUSTION CHAMBER OF AN INTERNAL COMBUSTION ENGINE

The present invention relates to a method of igniting a gas/fuel mixture in at least one combustion chamber of an internal combustion engine, said combustion chamber being supplied with fuel and gas.

Methods of and apparatuses for igniting a gas/fuel mixture are commonly known in which said gas/fuel mixture is ignited at the right moment and, thus, its combustion is to be initiated. In an Otto engine, ignition is effected by means of an electric spark at the electrodes of an ignition plug, whereas, in a diesel engine, said gas/fuel mixture, by compression, is brought to a temperature sufficiently high for initiating the ignition, various auxiliary starting means being provided for the start, e.g. glow plugs.

It is the object of the present invention to provide a method of and an apparatus for igniting a gas/fuel mixture in the combustion chamber of an internal combustion engine which, as compared with the known methods and apparatuses, enables an enhanced degree of efficiency to be achieved with a leaner mixture.

According to the present invention, this object is attained by the characterising features of the Main Claim and those of the subordinate Apparatus Claim.

Due to the fact that an expanding pulse-shaped pressure wave having a high energy density is generated in said combustion chamber, considerable temperature rises occur within that region which is being swept by said pressure wave so that the inflammable mixture present in said region ignites by itself and combustion of the same occurs with only a small amount of noxious matter. Although the energy density decreases in dependence on the distance of the source of said pressure wave, the energy generated by the combustion adds to the energy contents of said pressure wave so that the energy density necessary for self-ignition is maintained. Depending on the shape of said combustion chamber, the pressure wave is reflected by the walls and the piston-head, respectively, so that good intermixing of the gas/fuel mixture is effected, contributing to an enhanced combustion.

Since the excitation frequency of said pressure wave is in the ultrasonic range, i.e. the duration of the pressure pulse is in the microsecond range, the energy is concentrated in a closely confined space.

Advantageously, the pressure wave is generated by an arc or spark discharge of an ionised gas discharge gap defined by electrodes, whereby extremely powerful pressure waves and a good coupling to the gaseous medium are made possible. In addition to that, the electrodes defining said gas discharge gap are suited for high temperatures and pressures and in order to avoid excessive wear, tungsten or the like may be chosen as electrode material.

By providing an oscillatory circuit as drive circuit for said gas discharge gap, operated in the aperiodic limit case, a very high current can be momentarily supplied by discharging the capacitor, whereby a pulse-shaped pressure wave having a high energy, a low pulse duration and a short wave length is created due to the arc or spark discharge produced.

Advantageous further developments and improvements are possible by making use of the measures stated in the subclaims.

Figure 1:
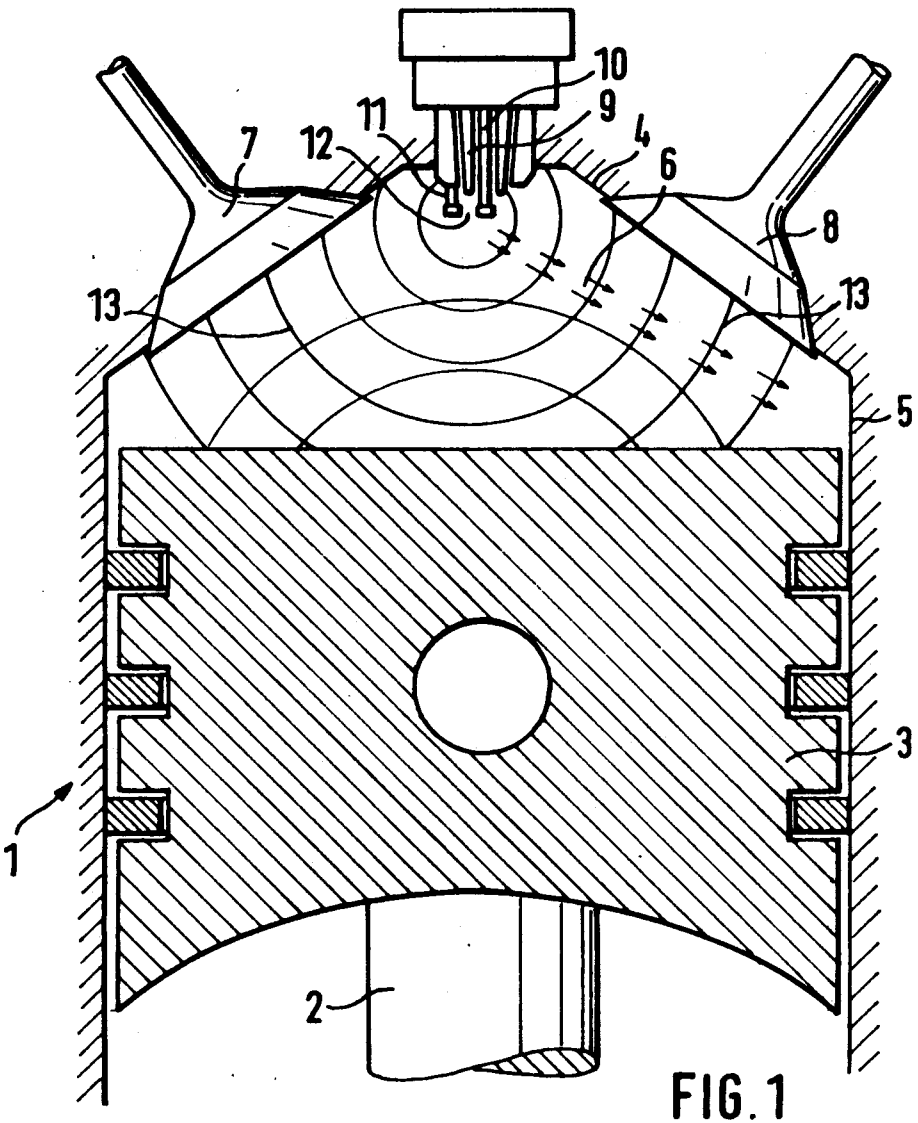
Figure 3:
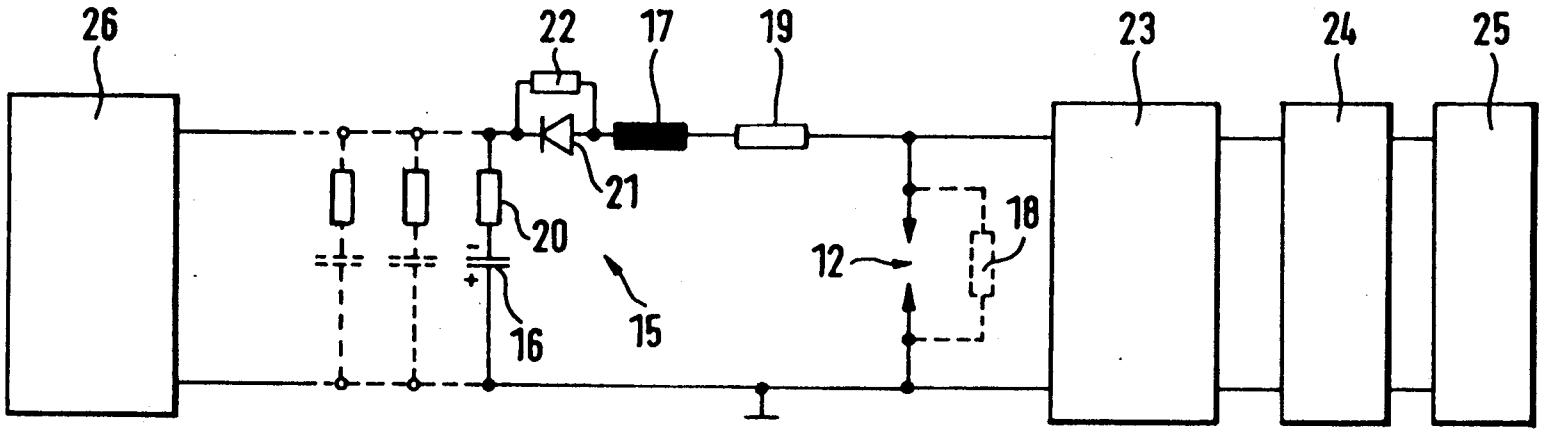

Embodiments of the present invention are shown in the drawings and will be explained in more detail in the course of the following description. There show:

FIG. 1 a partial section of a cylinder having a piston according to a first embodiment;

FIG. 2 a partial section of a cylinder having a piston according to a second embodiment, and FIG. 3 the circuit layout of the drive facility of the gas discharge gap.

With reference to FIG. 1, the method according to the invention shall be explained by way of example in connection with a reciprocating piston machine. A piston 3 connected with the connecting rod 2 reciprocates in the illustrated cylinder 1 of said reciprocating piston machine. A combustion chamber 6 to which an inlet valve 7 and an outlet valve 8 are allocated is defined by the piston 3 and the cylinder head 4 as well as the cylinder wall 5, respectively. An ultrasonic transducer 9 protrudes—like a conventional ignition plug—into the combustion chamber 6, through which transducer electric energy is converted into sonic energy in the ultrasonic range. The transducer 9 has two electrodes 10, 11 of good heat dissipation qualities which, preferably, are made of tungsten and which define a gas discharge gap 12 between themselves. For a better coupling, the space between the electrodes 10, 11 depends on the wave length of the pressure wave to be generated. The transducer 9 constitutes, so to say, a point source for the pressure wave to be generated.

By means of the drive circuit of said gas discharge gap 12, shown in FIG. 3 and described later on, a pulse-shaped arc or spark discharge is triggered between the electrodes 10, 11, whereby a powerful pulse-shaped pressure wave is created. The excitation frequency of said pressure wave is in the ultrasonic range, e.g. between 100 and 500 kc/s, i.e. the exciting pulse has a duration of a few microseconds.

Since the gas discharge gap 12 of the transducer 9 is to be considered, so to say, a point source, a spherical wave is created which successively propagates throughout said combustion chamber 6. The spherical wave is indicated in FIG. 1 by limb-shaped lines 13 at different times.

The combustion chamber contains an air/fuel mixture which, by way of example, has been injected before by means of an injection device not shown. The pressure wave expanding in the form of a sphere at phase velocity of sound causes a considerable pressure and temperature increase of the gas cells and the fuel particles when it sweeps the respective relatively small, bowl-shaped chamber so that said air/fuel mixture is brought to the point of self-ignition. It is true that the energy density of said pressure wave decreases—depending on the distance to the source—but, due to the self-ignition of said mixture, the energy is increased again by the combustion. The pressure wave is reflected at the boundary walls of said combustion chamber 6 and, thereby, scattered. Due to these reflections, the combustion chamber is swept several times by the pressure wave, whereby good intermixing of said air/fuel mixture is effected. In order to reduce scattering loss, said combustion chamber may be designed in a special manner, e.g. as shown in FIG. 2. According to this embodiment, the head of the piston is spherically shaped or provided with a special curvature, respectively.

The drive circuit for said ignition and said arc or spark discharge of the gas discharge gap 12 is shown in FIG. 3. In order to achieve an arc or spark discharge—from now on, reference will be made only to an arc discharge—the gas discharge gap is ionised before; e.g. a glow discharge is produced. An essential component part of said drive circuit according to FIG. 3 is constituted by an oscillatory circuit 15 with the capacitor 16 and the inductive resistor 17. The real equivalent resistor 18 of the gas discharge gap 12 is indicated by dashed lines and, in a state of ignition, is in the range between 100 mΩ and 10Ω. 19 denotes the lead resistors and the loss resistor 20 of the capacitor 16 is connected in series with the latter. A diode cascade is connected into the discharge circuit of said capacitor 16, said diode cascade being illustrated by the single diode 21. A resistor 22 is connected in parallel with each diode.

In general, several diodes 21 are required, since they must block the ignition voltage supplied to said gas discharge gap 12. In order to ensure that the individual voltages at said diode cascade are uniformly distributed, the resistors (in the megaohmic range) connected in parallel with each diode are provided. For ionising, i.e. for igniting, the gas discharge gap 12, an ignition unit 23 is provided which supplies the ignition voltage required. The ignition unit 23 is connected with a control device 24 which may be e.g. a microcomputer and which controls the timing of the ignition of said gas discharge gap 12. Sensors 25 are connected to said control device 24, which e.g. supply the information on the instantaneous position of the engine. The capacitor 16 is charged through a charging unit 26 which, e.g. in a car, consists of a voltage transformer, the task of which is to gain a high-voltage from the low-voltage supply system of said car.

For the arc discharge required, a current flow between several hundreds of amperes and some thousand amperes must be maintained during the given period of time of a few microseconds. The voltage resulting therefrom amounts to some 100 V. During said arc discharge, temperatures of some 1000° K. and pressures between 10 and 100 bars are created in the gas gap through which the current flows. The aforementioned values shall merely give an impression of the respective orders of magnitude.

Taking into consideration the lead resistors 19 and the real equivalent resistor 18 of said gas discharge gap 12, the oscillatory circuit 15, with a given excitation frequency, is tuned in such a manner that the entire charge of said capacitor, under conditions of the aperiodic limit case, is transformed into heat in said gas discharge gap 12 approximately during one oscillating period, i.e. during a very short period of time. The energy quantity, in this case, substantially depends on the amount of the capacitance of said capacitor 16 and its charging voltage. Since the discharge of said capacitor 16 is effected within a few microseconds, capacitors resistant to a pulse discharge (e.g. metallised-paper capacitors) must be used. The inductive resistor 17 is in the lead inductance range plus a tuning inductance by means of which tuning of said oscillatory circuit 15 is possible in the aperiodic limit case.

As indicated by dashed lines, several capacitors 16 may be connected in parallel for current distribution.

For ionising said gas discharge gap 12, i.e. for igniting the same, the ignition unit 23 supplies a high-voltage, the amount of said ignition voltage depending on the pressure dominating in the combustion chamber 6 at the time of ignition. After said ignition has been effected, the conducting voltage at the gas discharge gap drops and if it is lower than the sum of the capacitor voltage and the voltages of the barrier-layer capacitances of the diodes 21, the capacitor 16 rapidly discharges itself via said gas discharge gap 12 in accordance with the aperiodic discharging process and the arc or spark discharge is provided at a very high current. It goes without saying that, in such a case, said diodes 21 are dimensioned in such a way that they can stand the current pulses. Following the discharge of said capacitor 16, the arc discharge abruptly ends and the charging unit 26 recharges the capacitor 16. The charging unit 26 must be dimensioned in such a way that, also at the highest engine speed, complete charging of said capacitor is achieve. Moreover, the necessary charging voltage of said capacitor which, according to the inventive embodiment, may amount e.g. from 500 to 1000 V is dependent on the air/fuel ratio; in other words: the leaner the mixture is, the higher the charging voltage must be.

For controlling the duration of said current pulse, i.e. for controlling said excitation frequency, disconnectible thyristors or transistors for an adaptation to different engine speeds may be employed in said oscillatory circuit 15. By changing the duration of the current pulses, different energy transformation times are obtained; by that, those periods of time are meant which are required for transforming the acoustic energy into thermal energy.

According to the described embodiment, ignition of the gas discharge gap 12 is effected by applying the voltage of said ignition unit 23 to the two transducer electrodes 10, 11 themselves. Alternatively, the ignition unit 23 may be coupled in parallel to the diode chain in order that said capacitor 16 will not discharge itself via the secondary side of an ignition transformer. It is, however, also possible to provide a separated ignition electrode as third electrode, in which case separated ignition and discharge circuits are then provided and the diode cascade may be omitted.

The present invention has been explained with regard to a reciprocating piston engine. It stands to reason that said invention is not restricted to this kind of embodiment but is applicable also in connection with other types of internal combustion engines.

I claim:

1. Method of igniting a gas/fuel mixture in at least one combustion chamber of an internal combustion engine, said combustion chamber being supplied with fuel and gas, characterised in that an expanding pulse-shaped pressure wave of high energy density is generated in said combustion chamber at a frequency in the ultrasonic range, which pressure wave triggers a self-ignition of said mixture in the combustion chamber due to a local temperature increase.

2. Method according to claim 1, characterised in that said pressure wave is in the form of a spherical wave.

3. Method according to claim 1, characterised in that said pressure wave is generated by means of an arc or spark discharge of a gas discharge gap.

4. Method according to claim 3, characterised in that said gas discharge gap is ionised before said arc or spark discharge generating the pressure wave is effected.

5. Method according to claim 3, characterised in that the current required for effecting said arc or spark discharge is generated by a rapid discharge of a capacitor of an oscillatory circuit.

6. Method according to claim 1, characterised in that the pulse triggering said pressure wave has a duration between 1,0 and 10 microseconds.

7. Apparatus for performing the method according to claim 1, characterised in that a pressure transducer is inserted in the combustion chamber of an internal combustion engine, said pressure transducer generating an expanding pulseshaped pressure wave of high energy density.

8. Apparatus according to claim 7, characterised in that said pressure transducer is constructed as electroacoustic transducer which has a discharge gap defined by at least two electrodes.

9. Apparatus according to claim 8, characterised in that the electrodes are connected with an oscillatory circuit or are a component part of said oscillatory circuit which is dimensioned in such a way that the capacitor rapidly discharges itself, the frequency being in the ultrasonic range.

10. Apparatus according to claim 8, characterised in that an ignition unit is provided at the electrodes defining said gas discharge gap for effecting ionisation of the gas discharge gap.

11. Apparatus according to claim 9, characterised in that a high-voltage diode is provided in said oscillatory circuit for disconnecting the ignition unit supplying a high-voltage and the capacitor.

12. Apparatus according to claim 11, characterised in that an ignition unit for effecting ionisation of said gas discharge gap is provided in parallel to said diode.

13. Apparatus according to claim 8, characterised in that, in addition to the electrodes defining said gas discharge gap, an ignition electrode is provided which is connected with a separate ignition circuit.

14. Apparatus according to claim 9, characterised in that the oscillatory circuit is dimensioned in such a way that it operates under conditions of the aperiodic limit case.

15. Apparatus according to claim 9, characterised in that, for effecting a checked control of the discharge process of the capacitor, a switching element (thyristor or transistor) is provided in said oscillatory circuit.

* * * * *